United States Patent [19]

Bowen

[11] 3,974,307

[45] Aug. 10, 1976

[54] METHOD FOR COATING WOOD CHIPS WITH RESINOUS LIQUID

[76] Inventor: Michael E. Bowen, 1216 Johnson Drive, Miami, Okla. 74354

[22] Filed: Feb. 5, 1975

[21] Appl. No.: 547,233

[52] U.S. Cl. ..... 427/212; 118/418; 427/242

[51] Int. Cl.[2] ..... B05D 7/00

[58] Field of Search.... 427/212, 215, 216, 218–222, 427/233, 234, 235, 236, 239, 242, 356, 358, 368, 371; 118/19, 303, 418

[56] References Cited

UNITED STATES PATENTS

| | | | |
|---|---|---|---|
| 940,593 | 11/1909 | Hardman | 118/418 |
| 2,276,486 | 3/1942 | Harshberger | 118/303 |
| 2,276,487 | 3/1942 | Harshberger | 427/221 |
| 2,601,355 | 6/1952 | Wyss et al. | 118/303 |
| 2,626,875 | 1/1953 | McConnaughay | 427/220 |
| 2,684,206 | 7/1954 | Zettel | 118/418 |
| 2,840,842 | 7/1958 | Kaheny | 427/242 |
| 3,207,588 | 9/1965 | Slayter et al. | 427/219 |
| 3,916,825 | 11/1975 | Schnitzler et al. | 118/303 |

FOREIGN PATENTS OR APPLICATIONS

| | | | |
|---|---|---|---|
| 1,183,671 | 12/1964 | Germany | 118/303 |
| 2,019,481 | 11/1971 | Germany | 118/303 |

*Primary Examiner*—Michael R. Lusignan
*Assistant Examiner*—Dennis C. Konopacki
*Attorney, Agent, or Firm*—Klarquist, Sparkman, Campbell, Leigh, Hall & Whinston

[57] ABSTRACT

Wood chips used in making composition board are coated with a resinous liquid binder by first applying a coating of the resinous liquid to the inner surface of a moving wall portion of an enclosure for the chips and then moving the coated wall beneath the chips while simultaneously wiping the chips across the coated wall surface to remove resin from the surface and coat the chips. In an illustrated embodiment, the enclosure is a revolving drum with stationary end walls. Uncoated chips are fed into the drum through one end wall while coated chips are discharged through the opposite end wall. The interior of the drum is partitioned into a resin-applying compartment and a chip compartment. A spray applicator in the former applies resin to the inner surface of the revolving drum upstream of the chips while rapidly rotating paddles within the chip compartment move the particles into contact with the resin-coated inner surface of the drum.

8 Claims, 3 Drawing Figures

METHOD FOR COATING WOOD CHIPS WITH RESINOUS LIQUID

BACKGROUND OF THE INVENTION

1. Field of the Invention

The present invention relates to the blending of wood particles and a resinous liquid binder in the manufacture of a wood composition board product.

2. Description of the Prior Art

In the production of wood composition board, a liquid resin binder is applied to the chips to bind them together to develop strength and stability in the finished board product. It is estimated that about 90 percent of the composition board produced in the United States is bonded with a liquid urea-formaldehyde resin. Such resin is a major cost factor in the production of such board, about 40 percent of the total manufacturing cost. The quantity of resin required to obtain the desired distribution of resin over the surfaces of the wood chips for optimum board strength determines the efficiency of the blending operation and thus greatly influences the cost of manufacturing the composition board.

Existing blenders for applying resin to wood chips, although varying in design, have in common the feature of applying resin directly to the wood chips, usually by exposing the chips to a resin spray. In one form of existing blender a curtain of free-falling wood chips drops through a resin spray and is thus coated in this manner. In a second form of existing blender wood chips are fed into one end of a stationary drum and moved through the drum and out the opposite end by the rotary action of paddles turning within the drum. As the chips travel from one end of the drum to the other, they are sprayed with resin which is distributed through the mass of chips by the mixing action of the paddles. In such blenders which apply the resin directly to the chips, the coating process is inefficient in that far more resin is required to obtain a thorough coating of all surfaces of all chips than is theoretically necessary. Accordingly, there is a need for a more efficient blender which uses a minimum of resin to coat uniformly wood chips to the extent necessary to produce composition board of desired strength.

Therefore, a primary object of the present invention is to provide a method and apparatus for providing a uniform coating of resin on wood chips using a minimum quantity of resin for a given quantity of wood chips.

Another primary object of the invention is to obtain a more uniform distribution of resin over the surfaces of the wood chips or particles than is obtained with existing blenders.

The ultimate objective is a reduction in the manufacturing cost of composition board without any reduction in board strength.

SUMMARY OF THE INVENTION

In accordance with the present invention, wood chips or particles are coated with the resin indirectly, first by applying a controlled amount of resin to an intermediate surface and then wiping the chips or particles across the surface to remove the resin from the surface and coat the particles.

The blending apparatus of the invention comprises an enclosure for containing the wood particles with the enclosure including a moving wall. A resin applicator applies a coating of resin to the inner surface of the moving wall, after which the coated wall moves beneath a quantity of the wood particles to be coated. Agitating devices within the enclosure continuously move fresh wood particles to be coated into contact with and across the coated moving wall surface to wipe the resin from the wall surface onto the particle surfaces before the coated particles are discharged from the enclosure.

In a preferred embodiment of the invention, the blender comprises a generally horizontal rotary drum with stationary end walls. Wood chips to be coated are fed into one end of the drum and coated chips discharged from the other end continuously at a rate to maintain a constant level of particles within the drum. A resin supply pipe with multiple spray heads within the drum coats the inner surface of the rotary drum at a position upstream from the wood chips, after which rotation of the drum moves the coated inner drum surface beneath the chips as high-speed paddles rotate to wipe the chips across the coated moving surface of the drum to remove the resin from the drum and coat the chips as the drum revolves. A partition within the drum separates the resin applicator from the chip-containing portion of the drum to protect the applicator and to prevent direct application of resin to the chips.

The foregoing and other objects, features and advantages of the present invention will become more apparent from the following detailed description, which proceeds with reference to the accompanying drawing.

DETAILED DESCRIPTION

Figure 1:
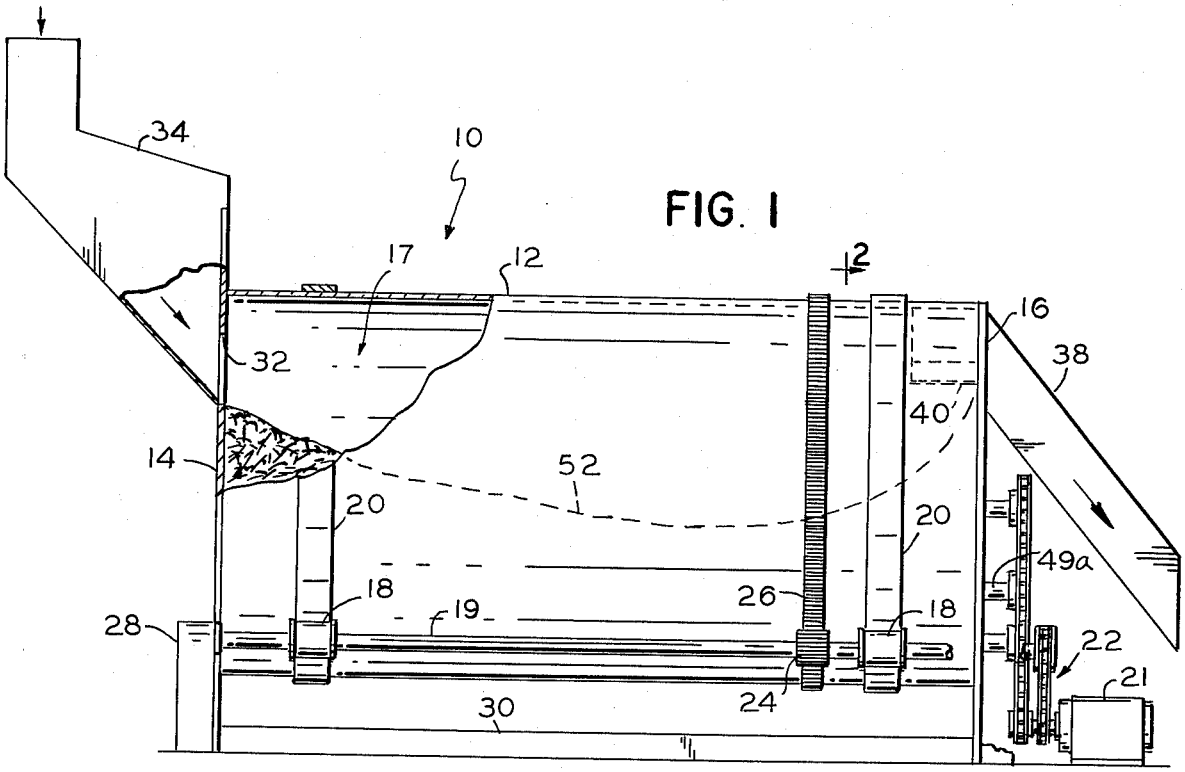
FIG. 1 is a side elevational view of a blender in accordance with a preferred embodiment of the invention with an outer portion removed to reveal an inner portion of the blender.

With reference to the drawing, a resin blender, indicated generally at 10, includes a generally horizontal rotary cylindrical drum 12 mounted between fixed upstanding end walls 14, 16. The drum defines an enclosure 17 within which the blending operation is carried out. The rotary drum is supported on bearing rolls 18 mounted on longitudinal shafts 19 extending along opposite lower side portions of the drum in supporting engagement with bearing straps 20 encircling the drum.

The drum is rotated at the desired speed unidirectionally that is in a constant direction of rotation by a motor 21. The motor drives shaft 19 through a chain-and-sprocket drive train, indicated generally at 22. A pinion 24 fixed to shaft 19 engages a gear rack 26 to provide the necessary speed reduction from the motor to the drum.

The shafts 19 are journaled at their opposite ends in upstanding end supports 28 extending upwardly from a base 30. End supports 28 and base 30 also support the fixed opposite end walls 14, 16.

Figure 3:
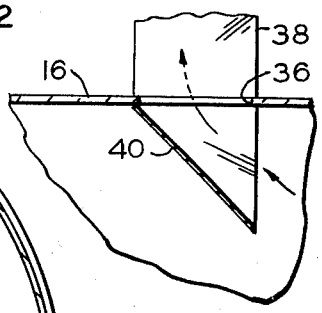
FIG. 3 is a horizontal sectional view taken along the line 3—3 of FIG. 2 showing the discharge portion of the blender.

End wall 14 includes an infeed opening 32 near its upper end through which wood chips are fed by gravity into the rotary drum from an infeed hopper or chute 34. The opposite end wall 16 includes a discharge opening 36 (see FIG. 3) at a central portion of its upper end through which resin-coated chips are directed to a discharge chute 38 by a deflector 40 fixed to the end wall.

The interior 17 of drum 12 is subdivided into two compartments including a resin applicator compartment 17*a* and a chip compartment 17*b* by a partition 42 extending between and fixed to opposite endwalls 14, 16. The partition extends at its top and bottom edges into close proximity to the inner surface 12*a* of drum 12 to prevent chips from entering the applicator compartment. The smaller resin applicator compartment 17*a* includes a resin supply pipe 44 extending the length of the drum and through one of the fixed end walls to a source (not shown) of liquid resin. The resin pipe 44 is provided with multiple airless spray heads 46, only one of which is shown, spaced along the interior length of such pipe. The spray heads are adapted to spray a uniform curtain of resin at a controlled rate onto the inner wall surface 12*a* of rotary drum 12 as the cylindrical wall of the drum revolves. Means (not shown) are provided for pumping the liquid resin from the resin source into the supply pipe 44.

A series of agitating means comprising four rotary paddle devices 48 are provided within the chip compartment 17*b* of enclosure 17. Each rotary paddle device 48 includes a tubular shaft 49 and a series of paddle blades 50 radiating from the shaft. Each paddle device is positioned closely adjacent to an inner surface portion of drum 12 in the region of the bottom portion of the drum. Reduced end portions 49*a* of the paddle shafts 49 extend outwardly of the drum through end wall 16. The paddle shafts are driven through a chain-and-sprocket drive arrangement from motor 21 as shown in FIG. 1, with the chain-and-sprocket drive providing the required rotational speed control.

Figure 2:
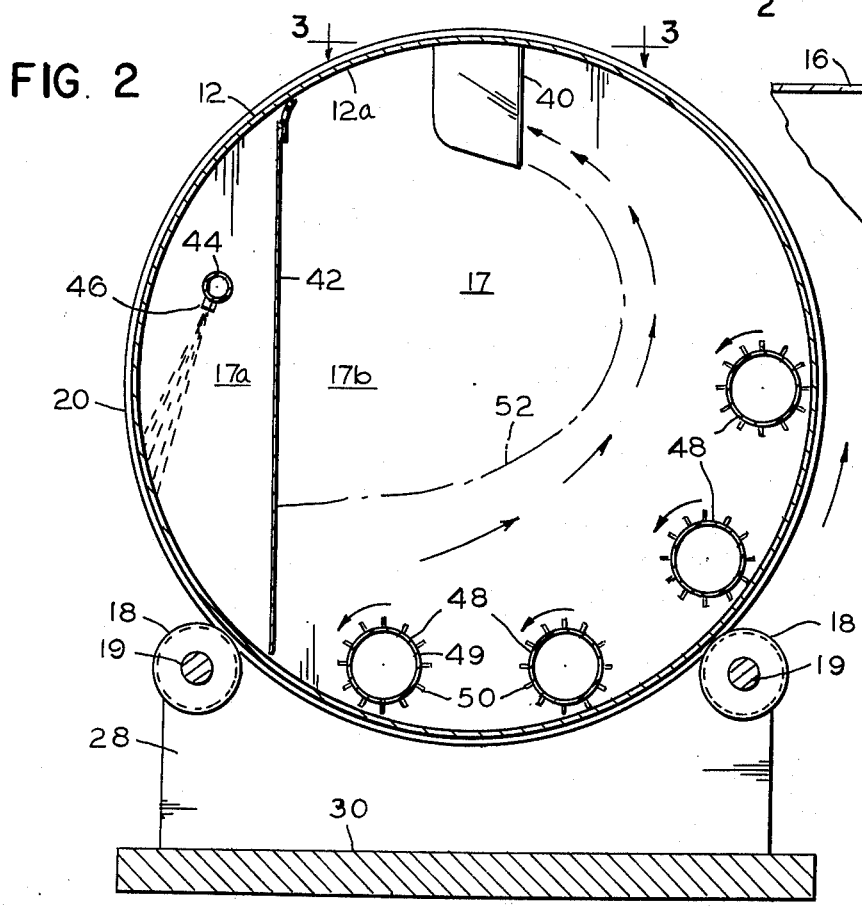
FIG. 2 is a vertical sectional view on an enlarged scale taken along the line 2—2 of FIG. 1 as viewed toward the discharge end of the blender.

As will be apparent from FIG. 2, the four paddles 48 are driven in the same direction of rotation as drum 12 so that the direction of movement of the paddle blades 50 when they are closest to the inner surface of the moving drum wall move in the same direction as the drum wall. However, the speed of rotation of the paddles is much faster than the rotational speed of the drum so that despite the rotation of the paddles and drum in the same direction, the paddles act to wipe the wood chips within compartment 17*b* across the resin-coated inner surface 12*a* of the drum to coat the chips.

The rotation of the paddles and drum in the same direction promotes the movement of the coated wood particles upwardly along the inner wall of the drum toward the discharge opening 36 in end wall 16 to facilitate discharge of the coated particles. In FIG. 1 the dashed line 52 represents the normal upper level of wood chips or particles within the drum while the same line 52 in FIG. 2 shows the upper level of wood chips or particles at the discharge end of the drum during operation of the blender.

In a typical blender installation the drum would be about 5 feet in diameter and 10 feet long with the paddles having an overall diameter of 8 inches and extending the full length of the interior of the drum. A typical drum speed would be 30 rpm while the paddles rotate at 1200 rpm in the same direction as the drum. The paddles would typically comprise a paddle shaft having a 7 inch outside diameter, each with twelve steel blades one-half inch long for an overall diameter of 8 inches. The spacing between the paddle blades and the inner wall 12*a* of the drum would typically be about 1/32 inch.

The drum blender is designed for continuous operation. The wood chips or particles are fed to and discharged from the drum by gravity. A vibrating screen (not shown) would be used if necessary to remove foreign matter from the entering material. The drum would normally be maintained approximately 50 percent full of particles during its continuous operation.

OPERATION

In operation, wood chips are continuously fed from chute 34 through infeed opening 32 of end wall 14 into chip compartment 17*b* of drum 12. The chips fall by gravity onto the top of a pile of chips 52 within the drum.

As the drum revolves continuously and slowly and the paddles 48 rotate rapidly in the same direction as the drum, a liquid resin binder is sprayed continuously onto the inner surface 12*a* of the revolving drum wall 12 to provide a uniform coating of the resin on such inner surface. The coated surface thereafter moves from applicator compartment 17*a* into the chip compartment 17*b* and beneath the quantity of chips within compartment 17*b*. Simultaneously paddles 48 move the uncoated chip material downwardly and rapidly across the resin-coated surface of the moving drum wall to wipe resin from the drum surface onto the particles. This process continues as the chips gradually work their way from the infeed end of the drum toward the discharge end by gravity. The motion of the drum and paddles eventually carries the resulting uniformly coated chips upwardly toward the discharge opening 36 of end wall 16 where deflector 40 guides the chips into the discharge chute 38. The chute then conveys the coated chips by gravity to the board-forming apparatus.

As previously noted, the process as described is continuous, with uncoated chips being continuously fed into the infeed end of the drum as coated chips are continuously discharged from the outfeed end of the drum.

METHOD

Essentially, the method of the invention involves the application of a controlled amount of resin coating to an intermediate surface and the subsequent transfer of the resin coating from such surface to wood particles or chips by wiping the particles or chips across such surface. This two-step process is facilitated by movement of the coated surface beneath the chip material and the simultaneous rapid movement of the material across the moving resin-coated surface.

The quantity of particles within the enclosure is agitated by the action of the rotating paddles to move different portions of such quantity into wiping contact with the coated moving inner wall surface as the wall moves beneath the quantity of particles.

Although in the illustrated preferred embodiment of the invention a rotary drum is utilized to carry out the method, other embodiments are within the scope of the invention. For example, the moving surface to which the resin is applied could comprise a continuously moving conveyor belt forming the bottom wall of a stationary generally rectangular bin enclosure, with paddles or other agitating devices being provided at intervals along the moving bottom wall of the container. Such a stationary enclosure could still include an interior partition separating the resin applicator compartment from the downstream chip compartment of the enclosure. As infeed opening at one upper end of the chip compartment would feed particles into the enclosure while the moving bottom wall and rotary action of the paddles would carry the chips as they are coated toward a discharge opening at the opposite end of the chip compartment.

Although the apparatus and method of the invention have been described in regard to their application to blending wood particles and liquid resin, for which the invention is particularly advantageous, it will be appreciated that the invention also has application in the blending of other liquid and particulate materials.

Having illustrated and described what is presently a preferred form of the invention, it should be apparent to those skilled in the art that the same may be modified in arrangement and detail without departing from the broad inventive concept disclosed. I claim as my invention all such modifications as come within the true spirit and scope of the following claims.

I claim:

1. A method of coating a quantity of wood particles within an enclosure with a resinous liquid binder comprising:

coating an inner surface of a moving wall of said enclosure containing said quantity of particles with said resinous liquid binder at a location on said wall upstream of said quantity of particles, moving said wall beneath said quantity of particles within said enclosure and simultaneously wiping said particles across said coated inner surface to remove said resinous liquid from said inner surface and coat said particles.

2. The method of claim 1 including continuously feeding particles to be coated into one portion of said enclosure and continuously discharging coated particles from another portion of said enclosure.

3. The method of claim 1 including agitating said quantity of particles to move different portions of said quantity into wiping contact with the coated moving inner wall surface as said wall moves beneath said quantity of particles.

4. The method of claim 1 including repeatedly agitating said quantity of particles at different positions along said moving wall as the coated inner surface of said moving wall moves beneath said quantity of particles so that individual particles of said quantity are repeatedly moved into wiping contact with the coated inner wall surface.

5. The method of claim 4 including agitating the quantity of particles using a rotary stirring motion in a direction and at a speed such that individual particles of said quantity are wiped across the coated moving inner surface of said moving wall in the same direction of movement as said wall.

6. The method of claim 1 wherein said moving wall is cylindrical and said movement is rotational and unidirectional about the axis of said cylindrical wall.

7. The method of claim 1 wherein said moving wall is curved to define a concavely curved said inner wall surface and wherein said curved wall is continuouslly rotated in the same direction of rotation during the coating process so that said quantity of particles are contained generally along a lower inner surface portion of the rotating wall and so that the particles tend to be carried by the rotating wall upwardly along the coated inner wall surface in the direction of rotation.

8. In a process of manufacturing a composite board product, the method of coating a quantity of wood particles with a resinous liquid binder preparatory to forming the coated particles into said composite board product comprising the steps:

feeding wood particles continuously into an entrance end of a continuously, unidirectionally rotating, generally horizontally disposed drum so that said particles tend to accumulate along a lower inner wall portion of said drum, coating an inner wall portion of said rotating drum with a resinous binder at a position upstream of the accumulation of said particles so that rotation of the drum moves said coated inner wall portion toward said accumulation, continuing the rotation of said drum to move the coated inner wall portion beneath the accumulation of particles, simultaneously with the movement of said coated inner wall portion beneath the accumulation of particles, stirring the accumulation of particles to move the particles into wiping contact with the coated inner wall portion to transfer the resinous binder from said inner wall portion to said particles, and while continuing the wiping contact of the particles with the rotating coated inner wall portion of said drum as aforesaid, moving the particles from said entrance end of said drum to an opposite exit end thereof and discharging the coated particles from said exit end.

* * * * *

UNITED STATES PATENT OFFICE

CERTIFICATE OF CORRECTION

PATENT NO. : 3,974,307

DATED : August 10, 1976

INVENTOR(S) : MICHAEL E. BOWEN

It is certified that error appears in the above-identified patent and that said Letters Patent are hereby corrected as shown below:

Column 5, line 3, "As" should be --An--;

Column 5, line 44, claim 4, "The method of claim 1" should be --The method of claim 3--.

Signed and Sealed this

Eleventh Day of January 1977

[SEAL]

*Attest:*

RUTH C. MASON
*Attesting Officer*

C. MARSHALL DANN
*Commissioner of Patents and Trademarks*